US006270234B1

(12) United States Patent
Au-Yeung

(10) Patent No.: US 6,270,234 B1
(45) **Date of Patent: *Aug. 7, 2001**

(54) PORTABLE LIGHT

(75) Inventor: Tin Shun-Victer Au-Yeung, Causeway (HK)

(73) Assignee: Lomak Industrial Co., Ltd., Niagra Falls (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/086,849

(22) Filed: May 28, 1998

(30) Foreign Application Priority Data

Sep. 25, 1997 (CA) ..... 2216502

(51) Int. Cl.[7] ..... F21L 4/00
(52) U.S. Cl. ..... 362/189; 362/200; 362/201
(58) Field of Search ..... 362/189, 200, 362/201, 208, 196, 199; D3/209; D26/37, 52, 38, 39, 46

(56) References Cited

U.S. PATENT DOCUMENTS

| | | | | |
|---|---|---|---|---|
| D. 390,678 | * | 2/1998 | Matthes | D26/37 |
| D. 412,355 | * | 7/1999 | Saetherbo | D22/118 |
| D. 422,081 | * | 3/2000 | Wolff | D24/136 |
| 3,085,149 | | 4/1963 | Giwosky . | |
| 3,256,428 | | 6/1966 | Schwartz . | |
| 3,359,411 | | 12/1967 | Schwartz . | |
| 3,899,670 | | 8/1975 | Delfortrie . | |
| 4,085,315 | | 4/1978 | Wolter et al. . | |
| 4,250,539 | | 2/1981 | Leitzel et al. . | |
| 4,368,507 | | 1/1983 | Reynolds . | |
| 5,029,055 | | 7/1991 | Lindh . | |
| 5,386,351 | * | 1/1995 | Tabor | 362/201 |
| 5,457,613 | | 10/1995 | Vandenbelt et al. . | |
| 5,463,539 | | 10/1995 | Vandenbelt et al. . | |
| 5,927,846 | * | 7/1999 | Sinclair | 362/189 |
| 5,949,328 | * | 9/1999 | Latty | 340/326 |

FOREIGN PATENT DOCUMENTS 2002084 5/1990 (CA) .

* cited by examiner

*Primary Examiner*—Cassandra Spyrou
*Assistant Examiner*—Leo Boutsikaris
(74) *Attorney, Agent, or Firm*—Angenehm Law Firm, Ltd; N. PaulFriederichs, III

(57) ABSTRACT

A portable light having a substantially planar upper surface. The upper surface has a width and length substantially greater than the thickness of the portable light and the battery used in the portable light has similar dimensions. The portable light may be a disposable light.

6 Claims, 4 Drawing Sheets

PORTABLE LIGHT

FIELD OF THE INVENTION

The present invention relates to a portable light that is substantially two-dimensional, with a battery therein that is also substantially two-dimensional, and which is connected to a lamp on the portable light by depression of a switch on the portable light. In embodiments, the light is a disposable light i.e. the light is used until the battery is drained and then it is intended to be discarded. Nonetheless, the battery and the bulb are capable of being replaced.

BACKGROUND TO THE INVENTION

There are a variety of portable lights, also known as flashlights or torches, with a range of shapes and sizes. Such flashlights typically have a switch that is capable of being moved between an ON and an OFF position, either using a sliding mechanism or by depression of a switch. The flashlights are constructed so as to be used with a variety of the common type of cylindrical batteries e.g. AA, AAA, C and D type batteries. Such batteries are widely available in the trade from a variety of manufacturers. Other flashlights use button cell batteries. The portable light of the present invention does not utilize any such cylindrical batteries or button cells.

The typical flashlights using cylindrical batteries tend to be relatively heavy, primarily as a result of the weight of the batteries. Moreover, the flashlights are generally not conveniently carried in a pocket or other part of apparel, due both to the size and weight of the light, and must be carried by hand or located in an accessible place, e.g. on a shelf, in a cupboard or in the trunk of a car. However, there are portable lights available in the form of a pen, which also use cylindrical batteries.

A peripherally sealed card-like flashlight device with a flat battery pack is disclosed in U.S. Pat. No. 5,457,613. This flashlight device is stated to handle and feel similar to a credit card.

A portable light is that capable of being unobtrusively and conveniently placed in a pocket, or which could be conveniently located in other locations, and which is lightweight, ergonomic, substantially planar in shape, and easily held would be useful. Such a portable light has now been found.

SUMMARY OF THE INVENTION

Accordingly, an aspect of the present invention provides a portable light having a substantially planar upper surface, said upper surface having a width and length that are substantially greater than the thickness of the portable light, said upper surface having a depressible switch therein and a lamp with reflector at one end, said light having a substantially planar battery adapted to be connected to said lamp when the switch is depressed.

In a preferred embodiment of the present invention, the depressible switch is centrally located in an ergonomic location when the portable light is held in a hand.

Another aspect of the present invention provides a portable light having a rigid housing, said housing having an upper surface with a width and length that are substantially greater than thickness of said housing, said upper surface having a depressible switch therein and a raised lamp housing at one end, said raised lamp housing having a light bulb with reflector attached thereto, said housing having a substantially planar battery therein that is adapted to be connected electrically to said lamp when the switch is depressed.

In a preferred embodiment of the portable light, the reflector is a directional reflector.

In another embodiment, the housing has two sections that are separable and are sealed together mechanically in a weather-resistant seal.

In a further embodiment, the battery is flat and thin.

BRIEF DESCRIPTION OF THE DRAWINGS

The present invention is illustrated by the embodiments shown in the drawings, in which.

BRIEF DESCRIPTION OF THE INVENTION

Figure 1:
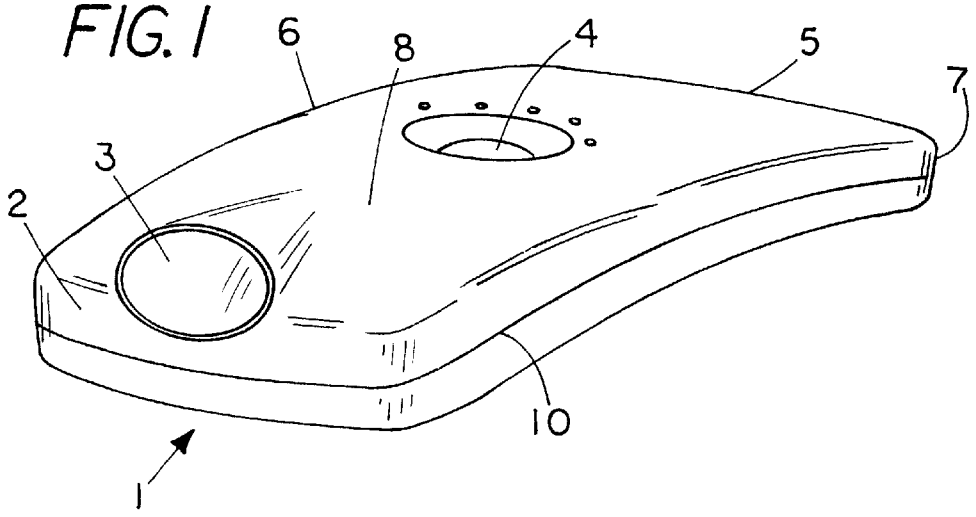
FIG. 1 is a schematic representation of a perspective view of the portable light of the invention.

FIG. 1 shows a portable light, generally indicated by 1, having a lamp housing 2 with lamp lens 3. Upper surface 8 of portable light 1 has switch 4 therein. Switch 4 is spaced apart from both end 5 and side 6. End 5 and side 6 are of substantially greater dimensions than edge 7 of portable light 1, resulting in portable light 1 being substantially two-dimensional.

Figure 2:
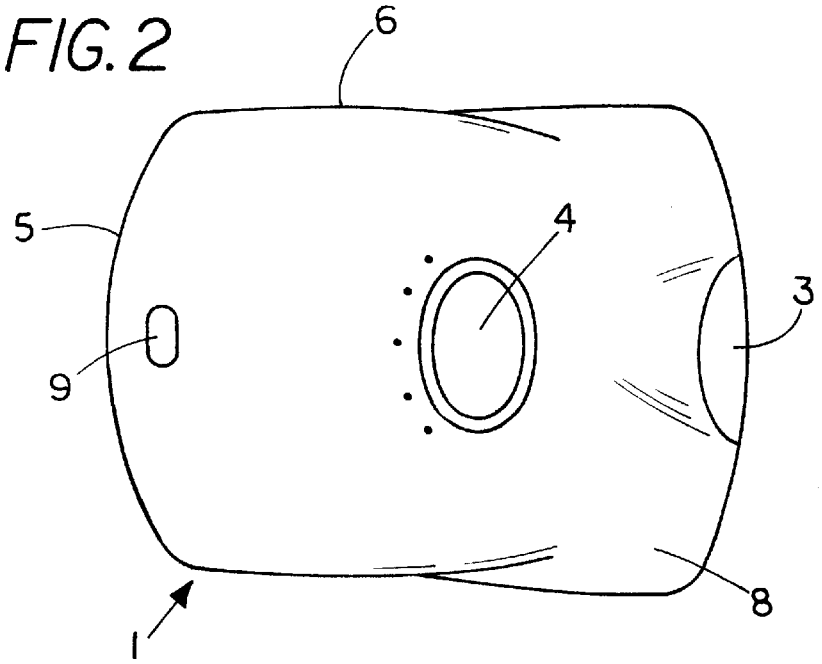
FIG. 2 is a schematic representation of a plan view of the top of the portable light.

FIG. 2 shows portable light 1 in a plan view, with lamp lens 3 being at one end of upper surface 8. Switch 4 is substantially centrally located, but disposed slightly towards lamp lens 3 to be in an ergonomically acceptable position. Upper surface 8 further has slot 9 juxtaposed to but separated from end 5 that is opposed to lamp lens 3. Slot 9 is particularly intended for attachment of a cord or chain for tying portable light 1 to a suitable location.

Figure 3:
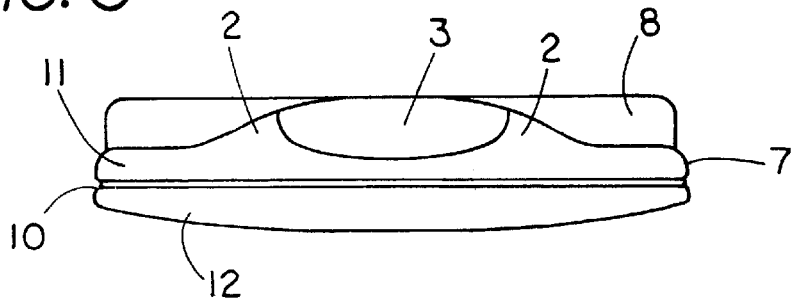
FIG. 3 is a schematic representation of a plan view of the front of the portable light.

FIG. 3 shows portable light 1 from a front end view, with lamp lens 3 being in lamp housing 2. Upper surface 8 is shown because, in the particular embodiment that is illustrated, upper surface 8 is slightly curved. Edge 7 of portable light 1 has join 10 therein, at which upper section 11 separates from lower section 12, for convenience of manufacture. Upper section 1 and lower section 12 are mechanically joined together to form a weather resistant seal. Nonetheless, upper section 11 and lower section 12 are separable as the two sections are held in place using screws, as discussed below.

Figure 4:
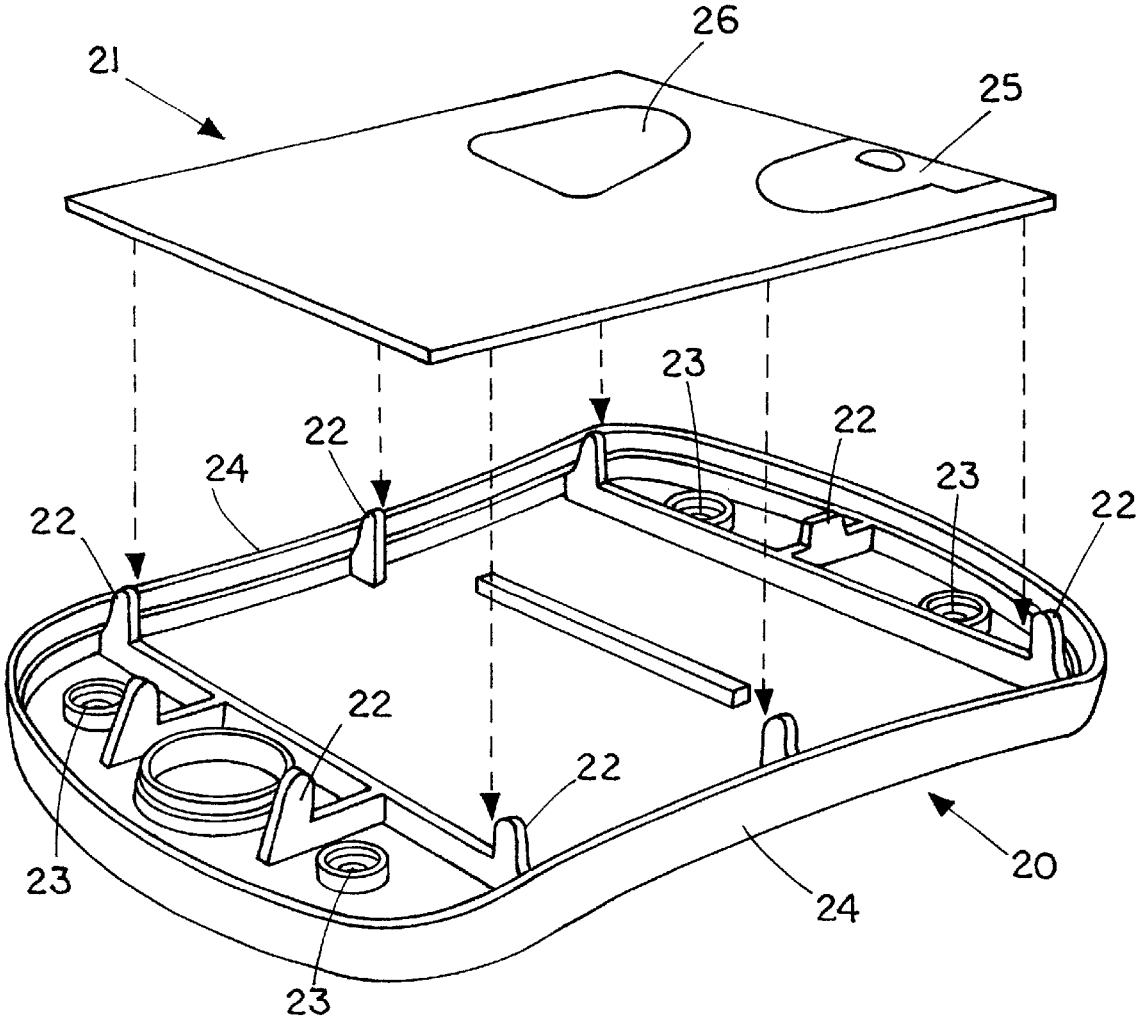
FIG. 4 is a schematic representation of an exploded view, in part, of the portable light.

FIG. 4 shows portable light 1, in part, in a exploded view. Lower housing 20 (corresponding to lower section 12) is separated from battery 21, it being understood that other parts of the portable light (not shown) would fit on top of battery 21. Lower housing 20 has a plurality of lower housing lugs 22, three disposed along each side of lower housing 20 juxtaposed but spaced apart from edge 24 of lower housing 20. In addition, two additional lower housing lugs 22 are shown towards one end of lower housing 20 and a further lower housing lug 22 is located on the opposed end. The lower housing lugs 22 are intended to accommodate and retain battery 21 in position. Lower housing 20 further has four screw holes 23, two located at each end of the housing. Battery 21 has first terminal 25 and second terminal 26 located on the upper surface thereof.

Figure 5:
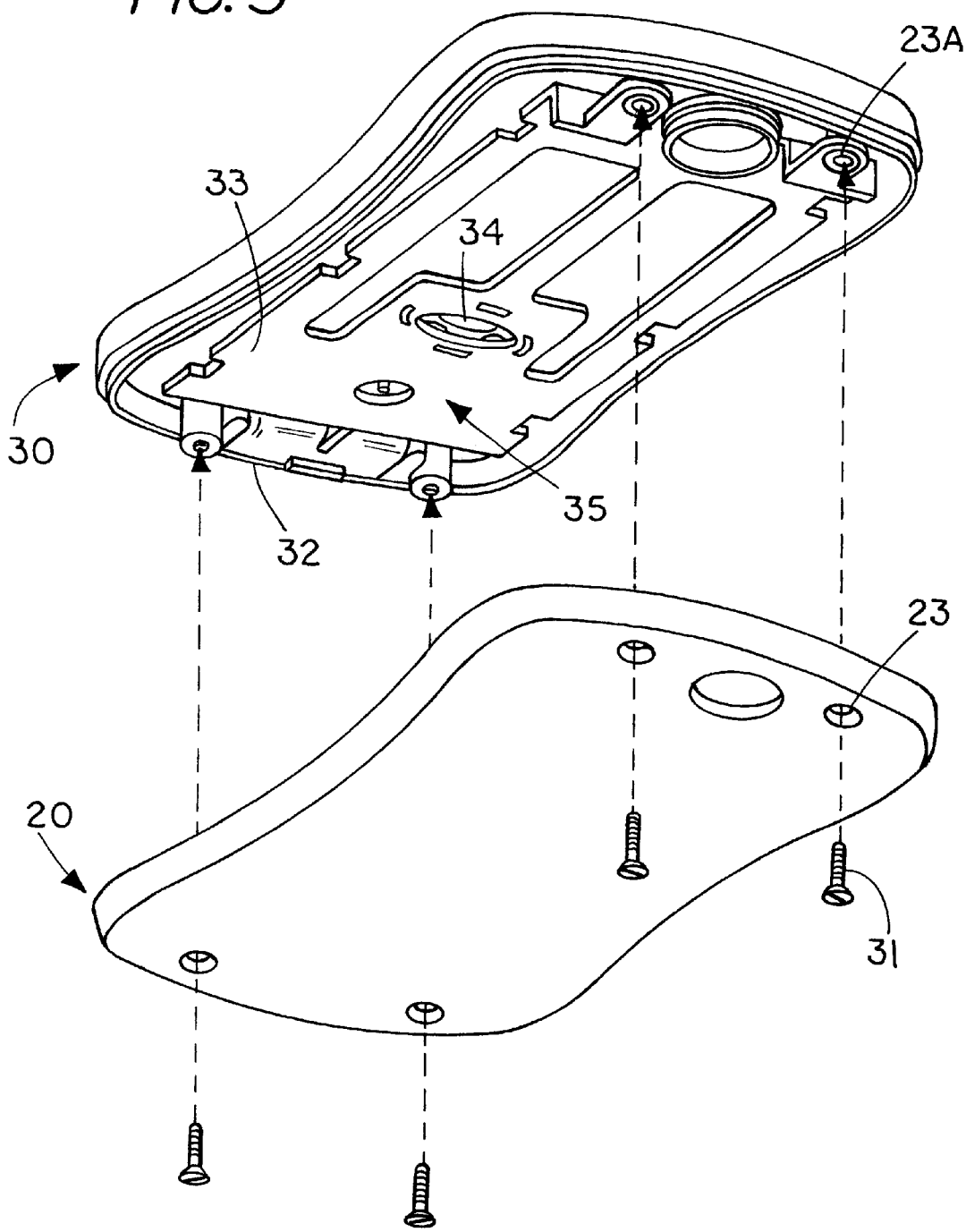
FIG. 5 is a schematic representation of a further exploded view of the portable light.

FIG. 5 shows upper housing 30 separated from lower housing 20. Battery 21 is not shown in FIG. 5 but would be located on lower housing 20 on the side opposed to that seen in the drawing. Screws 31 pass through screw holes 23 of lower housing 20 and into screw holes 23A located on upper housing 30. Upper housing 30 has lamp 32 located in one end thereof. Upper housing 30 further has diaphragm 33 located in a position that substantially corresponds to battery 21. Diaphragm 33 has switch plate 34 located in a central section thereof. Lamp 32 has lamp wire 35 extending inwardly across the surface of diaphragm 33 in a position that corresponds to first terminal 25 of battery 21.

Figure 6:
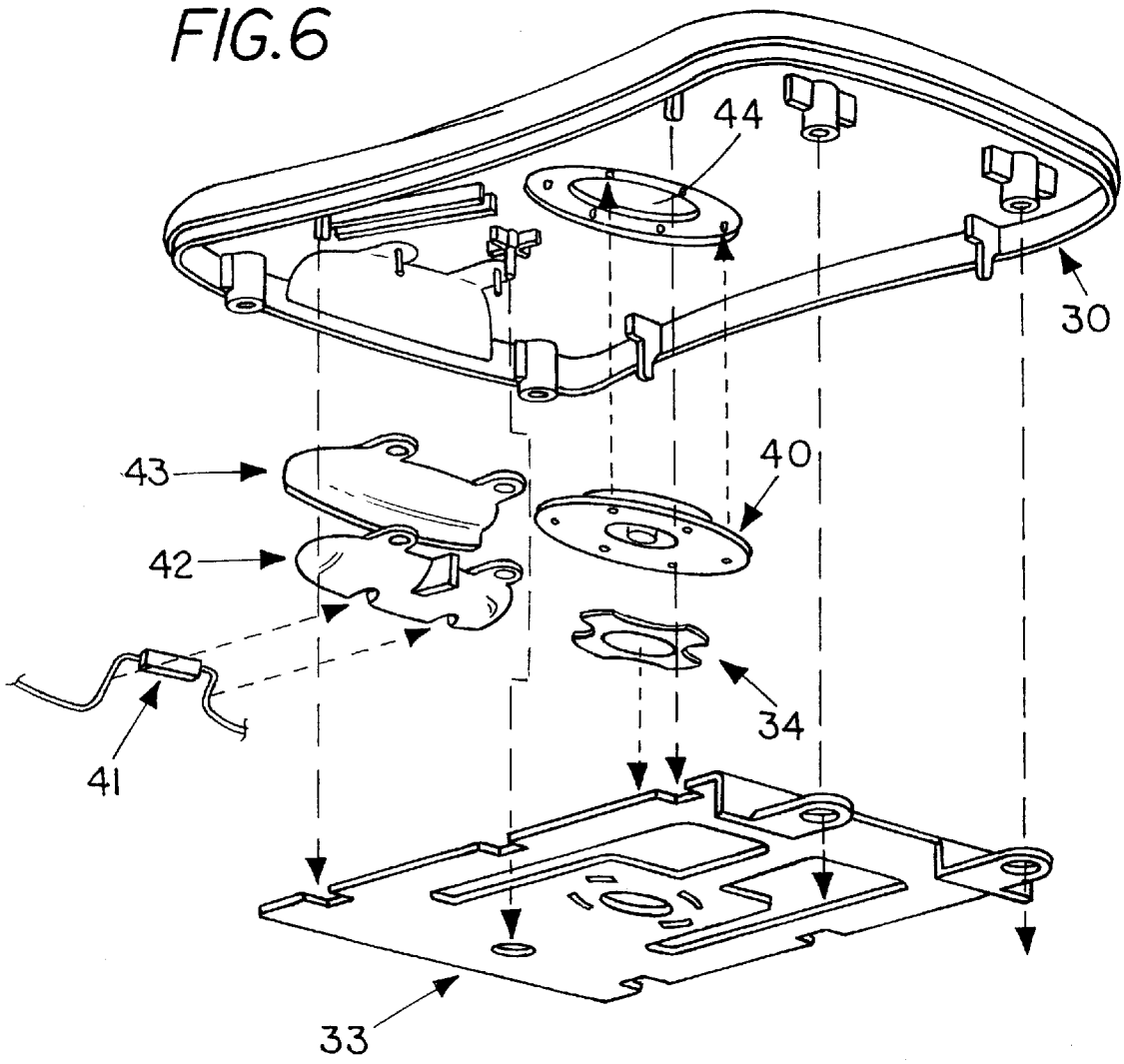
FIG. 6 is a schematic representation of another exploded view of the portable light.

FIG. 6 shows upper housing 30 separated from diaphragm 33. In upper housing 30, lamp 41 is shown as separated from reflector 42 and lamp lens 43. Lamp 41 is normally located between reflector 41 and lamp lens 43, to provide the light that is emitted from lamp lens 43. Switch 40 is shown as located under switch holder 44, but on installation fits into switch holder 44. Switch 40 is separated from switch plate 34 by a wire from lamp 41 (not shown). When switch 40 is depressed, switch plate 34 is moved into contact with battery 21, thereby completing an electrical circuit.

In operation, battery 21 is placed on lower housing 20, fitted between lower housing lugs 23. Diaphragm 33 is placed on upper housing 30, with a wire from lamp 41 i.e. lamp wire 35, on one side of diaphragm 33 so as to contact first terminal 25 of battery 21. A further lamp wire (not shown) is located on the opposed side of switch plate 34 to battery 21, such wire extending from lamp 41 to contact switch plate 34. The portable light is screwed together using screws 31.

When light is required, switch 40 is depressed which causes the lead from the lamp and switch plate 34 to be depressed and contact second terminal 26. This completes an electrical circuit, from battery 21 through first terminal 25 and wire 35 to lamp 41, through the wire not shown to switch plate 34 and first terminal 25, which is part of battery 21 and completes the circuit. Lamp 41 is thereby lit. Removal of pressure on switch 4 breaks the electrical circuit.

As an example of the portable lamp of the present invention, the housing of the portable light is approximately 7.5 cm wide, 10.5 cm long and with a thickness varying between 0.8 and 1 cm. However, the raised lamp housing has a thickness of approximately 1.8 cm, with the raised lamp housing being smoothly contoured into the remainder of the housing. The housing was in two parts, sealed together mechanically to provide a weather resistant seal. The two parts of the housing are held together using four screws, and are separable on removal of the screws. The centre of the switch is located approximately 5.8 cm from the rear of the portable light, centrally located across the width of the light.

The portable light will fit into the pocket of a shirt or trousers, into purses or other convenient locations. It is lightweight and easily transported. It is also ergonomic and easily held and used. However, it is substantially thicker than a card, and thus is not to be construed as "card-like". Examples of dimensions are given above.

What is claimed is:

1. A portable light comprising a rigid housing having an upper surface with a width and length that are substantially greater than a thickness of said housing, said upper surface having a depressible switch therein and a raised lamp housing in one end, said raised lamp housing having a lamp lens that forms part of the housing, said lamp lens enclosing a light bulb and directional reflector, said housing having a substantially planar battery therein coplanar with an internal diaphragm, said internal diaphragm being supported by being attached to the housing, said internal diaphragm having a switch plate thereon, said switch plate connecting electrically between the depressible switch and the battery when the switch is depressed thereby providing an electrical circuit between the lamp and the battery, said raised lamp housing being smoothly contoured with said rigid housing, the rigid housing including said lamp housing forming a substantially planar upper surface.

2. The portable light of claim 1 in which the depressible switch is centrally located in an ergonomic location when the portable light is held in a hand.

3. The portable light of claim 2 in which the housing has two sections that are separable and are sealed together mechanically in a weather-resistant seal.

4. The portable light of claim 3 in which the battery is flat and thin.

5. The portable light of claim 4, which is a disposable light.

6. The portable light of claim 1 in which the battery is held in position by lugs.

* * * * *